US005160056A

United States Patent [19]

Yoshimatsu et al.

[11] Patent Number: 5,160,056

[45] Date of Patent: Nov. 3, 1992

[54] SAFETY DEVICE FOR CRANE

[75] Inventors: Hideaki Yoshimatsu, Akashi; Norihiko Hayashi, Kakogawa; Hideki Kinugawa, Himeji, all of Japan

[73] Assignee: Kabushiki Kaisha Kobe Seiko Sho, Kobe, Japan

[21] Appl. No.: 588,929

[22] Filed: Sep. 27, 1990

[30] Foreign Application Priority Data

Sep. 27, 1989 [JP] Japan ..... 1-251250
Mar. 26, 1990 [JP] Japan ..... 2-77258

[51] Int. Cl.[5] ..... B66C 13/16; B66C 13/18; B66C 23/88

[52] U.S. Cl. ..... 212/155; 212/149; 212/150; 212/153; 212/156

[58] Field of Search ..... 212/155, 150, 146, 147, 212/149, 151, 154, 156, 168, 222, 153, 157

[56] References Cited

U.S. PATENT DOCUMENTS 2,916,162 12/1959 Gercke ..... 212/147
4,216,868 8/1980 Geppert ..... 212/155
4,997,095 3/1991 Jones et al. ..... 212/147

FOREIGN PATENT DOCUMENTS 0063709 11/1982 European Pat. Off. .
0154069 9/1985 European Pat. Off. .
2901488 7/1979 Fed. Rep. of Germany ..... 212/150
2204014 11/1988 United Kingdom .

*Primary Examiner*—Joseph F. Peters, Jr.
*Assistant Examiner*—Kenneth Lee
*Attorney, Agent, or Firm*—Oblon, Spivak, McClelland, Maier & Neustadt

[57] ABSTRACT

A safety device for a crane which can make a safety operation precisely taking a relationship between a swinging condition of a boom and a limit working region into consideration. In the device, a working radius and a swinging angle of the boom and projection amounts of projectable support members of the crane are detected, and a limit working region of the boom is set in accordance with a weight of a suspended cargo and the projection amounts. A remaining angle over which the boom can be swung until the set limit working region is exceeded is calculated, and also a braking angular acceleration at which swinging movement of the boom is braked and stopped without leaving a shake of the suspended cargo is calculated. Further, a swinging angle of the boom required to brake and stop the swinging movement of the boom at the braking angular acceleration is calculated, and the thus calculated required angle and the remaining angle are compared with each other. Thus, a safety operation is performed before the remaining angle exceeds the required angle. Meanwhile, the set limit working region and a current working radius and swinging angle of the boom are indicated on the same screen of a display unit.

4 Claims, 11 Drawing Sheets

| FIG. 2A | FIG. 2B |
|---|---|

SAFETY DEVICE FOR CRANE

BACKGROUND OF THE INVENTION

1. Field of the Invention

This invention relates to a safety device for a crane in which a boom is supported for swinging movement, and more particularly to a safety device for a crane of the type mentioned for setting a limit working region of the crane in accordance with a weight of a suspended cargo and performing a safety operation such as compulsory braking or stopping of the crane or alarming in response to such limit working region.

2. Description of the Related Art

Generally, a crane in which a boom is mounted for swinging movement includes such a safety device as will automatically stop the crane compulsorily when a working condition exceeds a safe region in order to prevent buckling, tipping and so forth of the crane.

Conventionally, in such device, allowable conditions are set equally over the entire region of 360 degrees irrespective of a swinging angle of the boom, but outrigger jacks provided on the crane may not always be projected completely, and depending upon a working location such as a narrow road, the amounts of projection of some of the outrigger jacks may be different from those of the remaining outrigger jacks. In such an instance, it is necessary to change the allowable conditions also in accordance with the swinging angle of the boom.

An arrangement is disclosed in Japanese Patent Laid-Open No. 57-27893 wherein a working condition of a crane is detected every moment and a rated load of the crane is determined from the thus detected value and preset values of the suspending capacity of the crane stored in a memory for various conditions of the crane, and a safety operation is performed based on comparison between the rated load and an actual load.

Since a calculated rated load and an actual load are compared with each other in this manner, the arrangement is convenient for the determination whether or not a current load can be suspended with a current length of the boom and a current working radius kept fixed. However, it is difficult to recognize such a limit working region to which position the boom can be swung with the load suspended thereon. Accordingly, it is substantially impossible to control a safety operation in which a limit working region may be exceeded by swinging movement of the boom.

Another arrangement is disclosed in Japanese Utility Model Laid-Open No. 62-89289 wherein an allowable swinging range of a boom is stored for each of the amounts of projection of individual outrigger jacks, and swinging movement and driving of the boom are stopped when an actual working condition exceeds the allowable swinging range.

In this arrangement, the boom is braked at an instant when the boom exceeds an allowable working region by its swinging movement. However, since inertial force by the swinging movement acts upon the boom, the swinging movement cannot be stopped quickly, and actually, even if the boom is braked, it will make further swinging movement over a certain angle. Consequently, the position at which the boom is stopped will actually come outside the limit working region. Besides, if urgent stopping is attempted with the intention of stopping the swinging movement in a period of time as short as possible, the suspended cargo will swing wildly due to the influence of inertial force, which will deteriorate the safety.

SUMMARY OF THE INVENTION

It is an object of the present invention to provide a safety device for a crane which can perform a safety operation precisely while considering a relationship between a swinging condition of a boom and a limit working region into consideration.

In order to attain the above object, according to one aspect of the present invention, there is provided a safety device for a crane which includes a boom mounted for swinging movement and a plurality of support members mounted for projecting movement and wherein a suspended cargo is suspended at a predetermined position of the boom, the safety device comprising working radius detecting means for detecting a working radius of the boom, swinging angle detecting means for detecting a swinging angle of the boom, support member detecting members for detecting projection amounts of the support members, limit working region setting means for setting a limit working region of the boom in accordance with a weight of the suspended cargo and projection amounts of the support members, remaining angle calculating means for calculating a remaining angle over which the boom can be swung until the set limit working region is exceeded, braking angular acceleration calculating means for calculating a braking angular acceleration at which swinging movement of the boom is braked and stopped without leaving a shake of the suspended cargo, required angle calculating means for calculating a swinging angle of the boom required to brake and stop the swinging movement of the boom at the braking angular acceleration, comparing means for comparing the thus calculated required angle and the remaining angle, and operating means for performing a safety operation before the remaining angle exceeds the required angle.

With the safety device, a safety operation is started at a point of time at which an angle can be assured which is required to stop the boom within the limit working region without causing uncontrolled swinging (shaking) of the suspended cargo. Consequently, the boom can be smoothly stopped within the limit working region with certainty.

According to another aspect of the present invention, there is provided a safety device for a crane which includes a boom mounted for swinging movement and a plurality of support members mounted for projecting movement and wherein a suspended cargo is suspended at a predetermined position of the boom, the safety device comprising working radius detecting means for detecting a working radius of the boom, swinging angle detecting means for detecting a swinging angle of the boom, support member detecting members for detecting projection amounts of the support members, limit working region setting means for setting a limit working region of the boom in accordance with a weight of the suspended cargo and projection amounts of the support members, and display means for indicating the thus set limit working region and a current working radius and swinging angle of the boom on the same screen.

With the safety device, a relationship between the limit working region and a current swinging condition of the boom is indicated on a single screen, and information necessary to perform safe swinging operation is provided to an operator. Consequently, the operator can recognize the relationship between them at a glance, and accordingly, the operator can proceed with precise swinging movement of the boom while taking the safety into consideration.

The above and other objects, features and advantages of the present invention will become apparent from the following description and the appended claims, taken in conjunction with the accompanying drawings.

DETAILED DESCRIPTION OF THE PREFERRED EMBODIMENT

Figure 9:
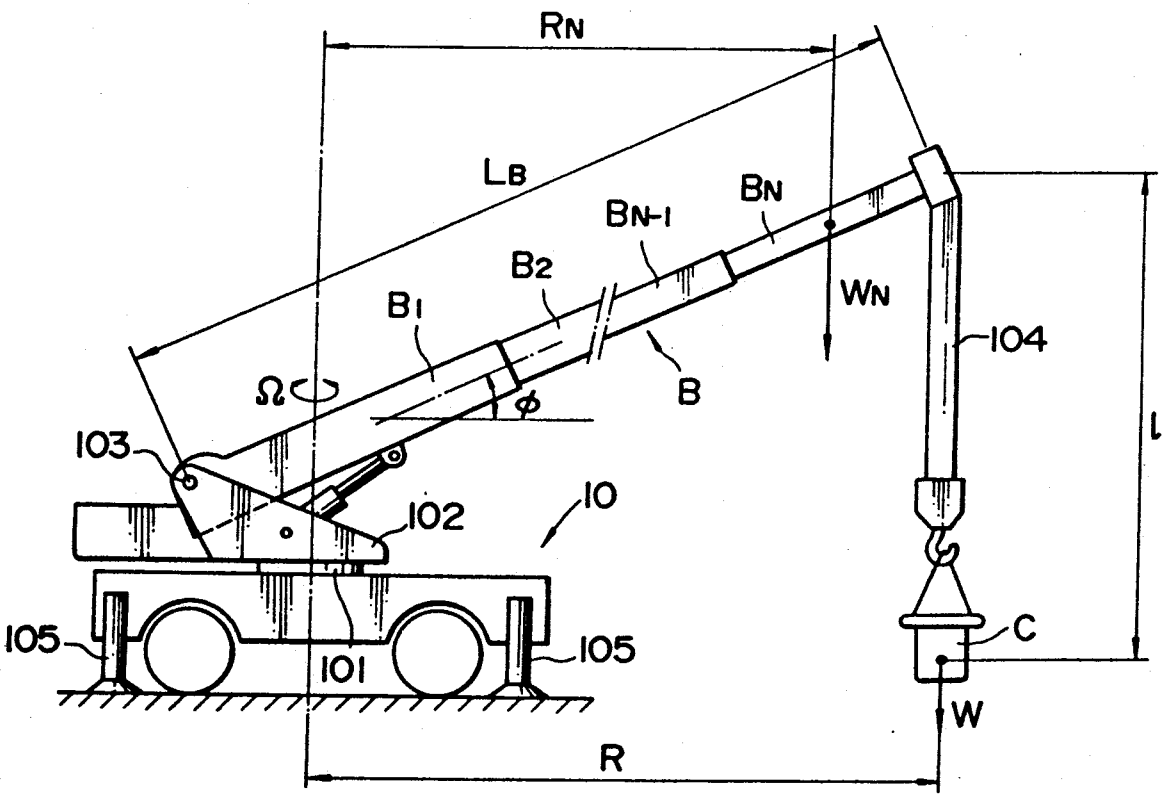
FIG. 9 is a side elevational view of a crane in which a safety device according to the present invention is incorporated.

Referring first to FIG. 9, there is shown a crane in which a safety device according to the present invention is incorporated. The crane generally denoted at 10 includes a boom foot 102 mounted for swinging movement around a vertical swing shaft 101, and an extensible boom B consisting of N boom members $B_1$ to $B_N$ is mounted on the boom foot 102. The boom B is constructed for pivotal movement (up and down tilting movement) around a horizontal pivot shaft 103, and a suspended cargo C is suspended at an end (boom point) of the boom B by means of a rope 104. It is to be noted that $B_n$ (n=1, 2, . . . , N) in the following description denotes an n-th boom member as counted from the boom foot 102 side.

Meanwhile, outrigger jacks (projectable support members) 105 are disposed for sideward projection at four front and rear, left and right corners of a lower frame of the crane 10.

Figure 1:
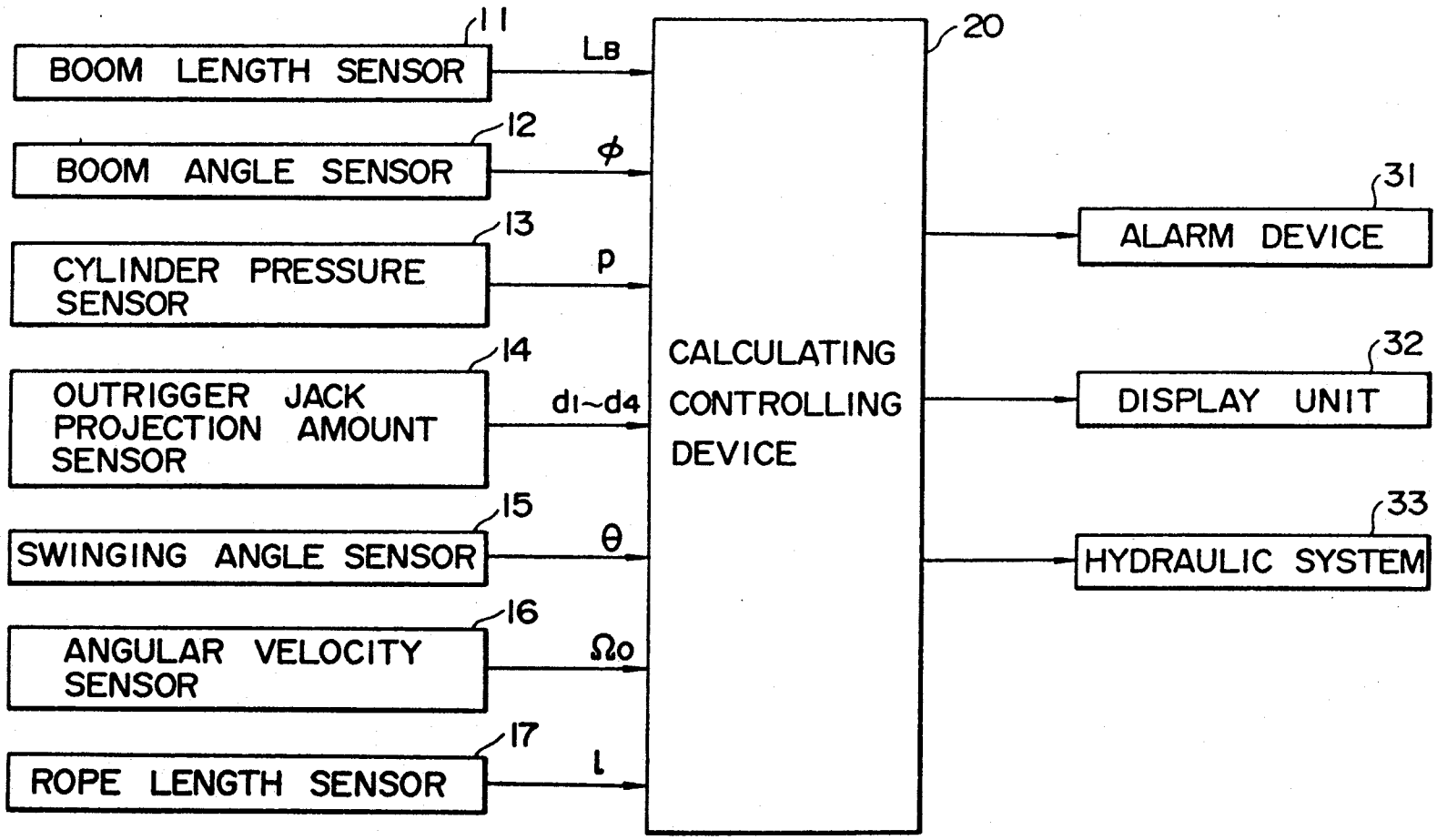
FIG. 1 is a block diagram showing inputs and outputs of a calculating controlling device of a safety device to which the present invention is applied.

Referring to FIG. 1, a boom length sensor 11, a boom angle sensor 12, a cylinder pressure sensor 13, four outrigger jack projection amount sensors 14, a swinging angle sensor 15, an angular velocity sensor 16 and a rope length sensor 17 are disposed on the crane 10, and detection signals of those sensors 11 to 17 are transmitted to a calculating controlling device 20 while control signals are transmitted from the calculating controlling device 20 to an alarm device 31, a display unit 32 having a display screen and a hydraulic system 33 for the swinging movement.

Figure 2A:
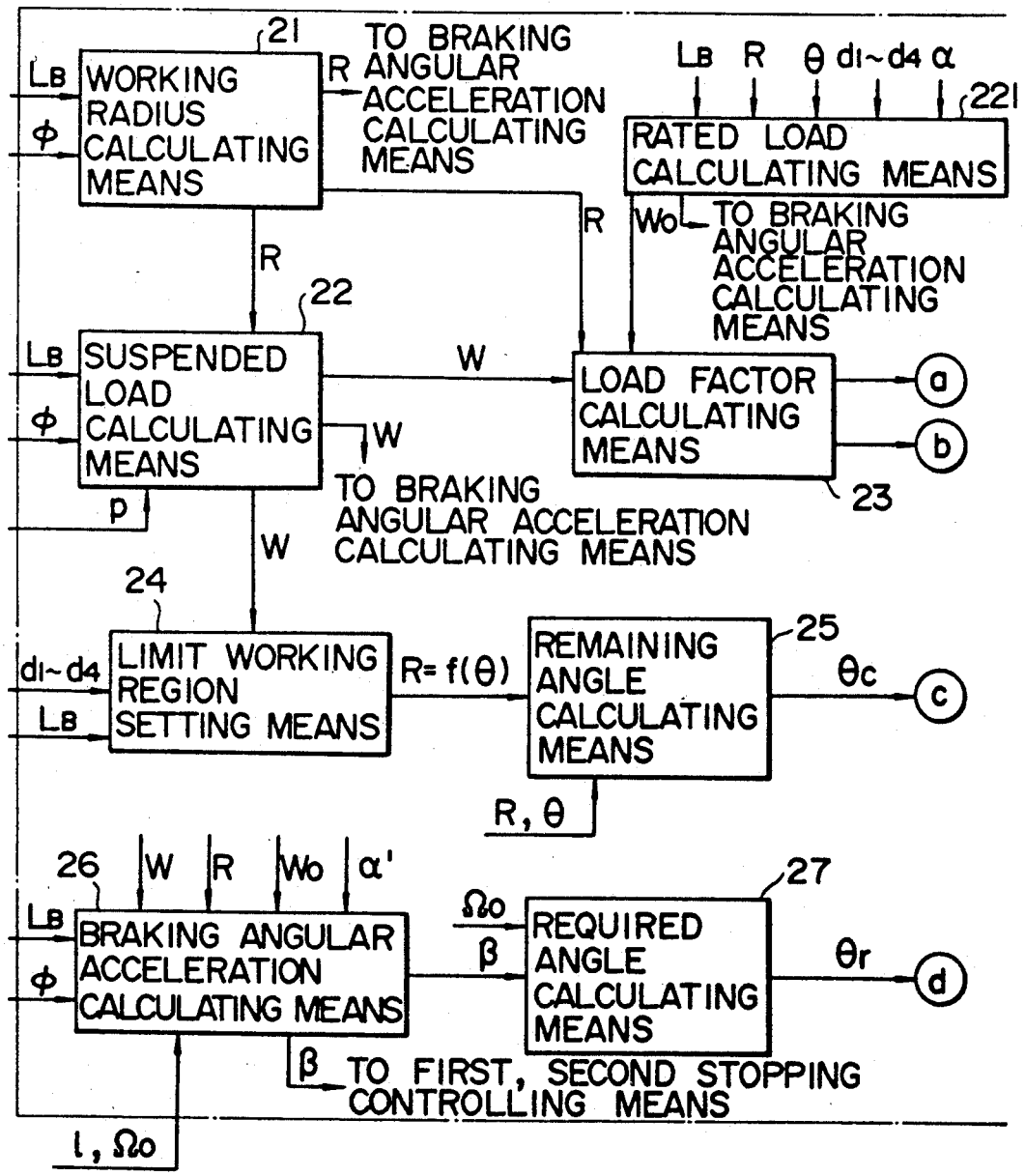
FIGS. 2A and 2B show a functional block diagram of the calculating controlling device of FIG. 1.
Figures 2, 2B:
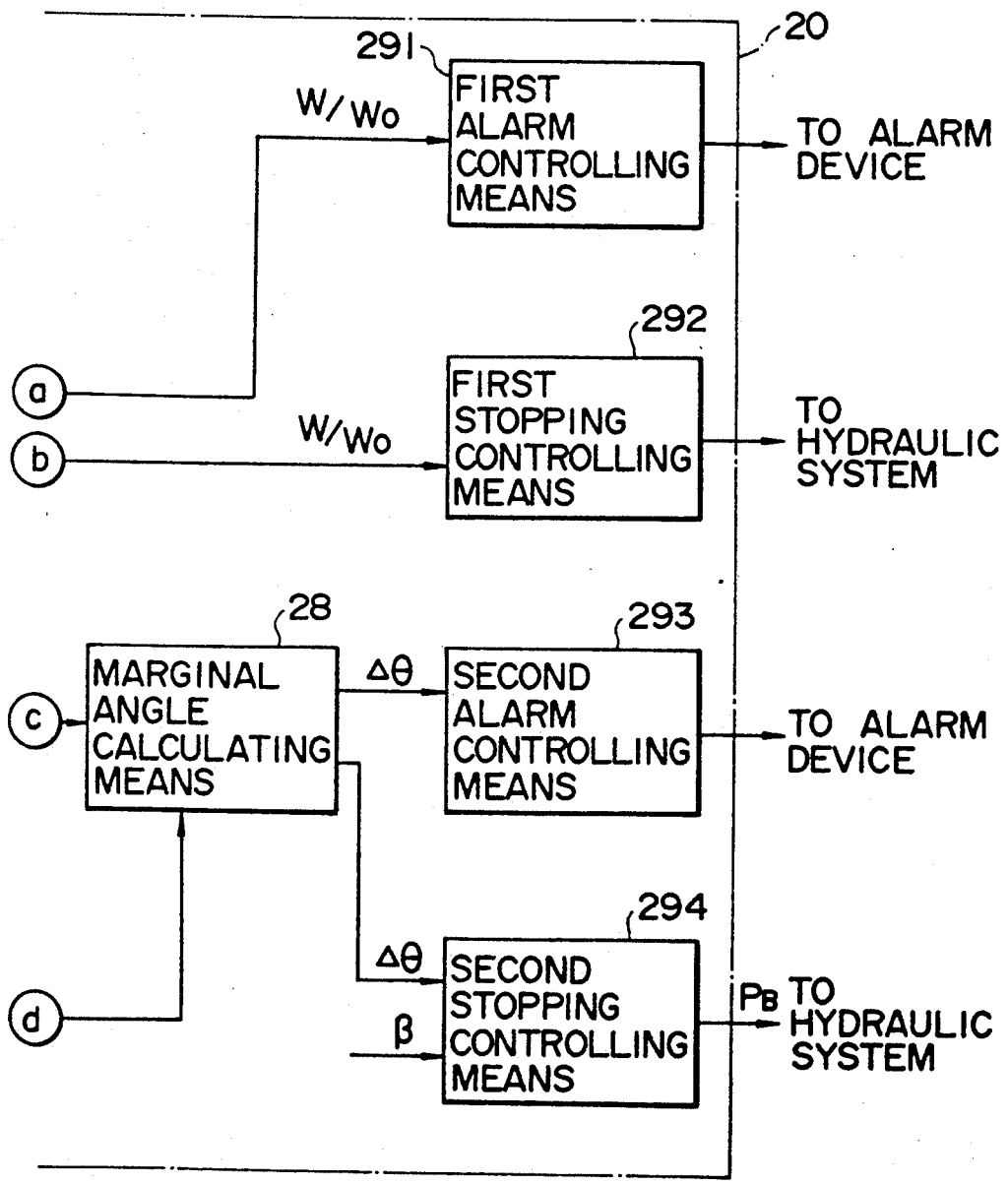

Referring now to FIG. 2, there is shown detailed functional construction of the calculating controlling device 20. The calculating controlling device 20 is constructed so that it may execute roughly two controls including 1) calculating control relating to a load factor, and 2) calculating control relating to a limit working region.

1) Functional Construction Relating to Calculating Control of a Load Factor

The calculating controlling device 20 includes working radius calculating means 21 which calculates a working radius R of the suspended cargo C using a boom length $L_B$ and a boom angle $\phi$ detected by the boom length sensor 11 and the boom angle sensor 12, respectively. Suspended load calculating means 22 calculates a load W of the suspended cargo C actually suspended on the boom B using such boom length $L_B$ and boom angle $\phi$ and a cylinder pressure p of a boom upper cylinder detected by the cylinder pressure sensor 13.

Rated load calculating means 221 calculates a rated load $W_0$ using the working radius R, the boom length $L_B$, a safety factor $\alpha$, a swinging angle $\theta$ detected by the swinging angle sensor 15 and projection amounts $d_1$, $d_2$, $d_3$ and $d_4$ detected by the outrigger jack extension amount sensors 14. Load factor calculating means 23 calculates a ratio of an actually suspended load W to the rated load $W_0$, that is, a load factor $W/W_0$.

First alarm controlling means 291 delivers a control signal to the alarm device 31 to develop an alarm at a point of time when the load factor $W/W_0$ calculated by the load factor calculating means 23 exceeds 90%. First stopping controlling means 292 delivers, at a point of time when the load factor $W/W_0$ exceeds 100%, a control signal to the hydraulic system 33 to compulsorily stop a crane operation (such as extension or tilting down movement of the boom B, winding up of the suspended cargo C and so forth) except a swinging operation.

A load factor $W/W_0$ is thus calculated by such means described above, and a safety operation is controlled in response to the load factor $W/W_0$.

2) Functional Construction Relating to Calculating Control of a Limit Working region Limit working region setting means 24 calculates a limit working region of the crane 10 under the conditions described above, that is, a region in which the end of the boom B can be moved within a safe region, using the suspended load W, the projection amounts $d_1$ to $d_4$ of the individual outrigger jacks 105 detected by the outrigger jack projection amount sensors 14 and the boom length $L_B$. The region is given by a relational expression $\theta=f(R)$ of the swinging angle $\theta$ and the working radius R. Meanwhile, remaining angle calculating means 25 calculates a remaining angle $\theta_o$ over which the boom B can be swung from its current position until the limit working region is exceeded.

Figure 3:
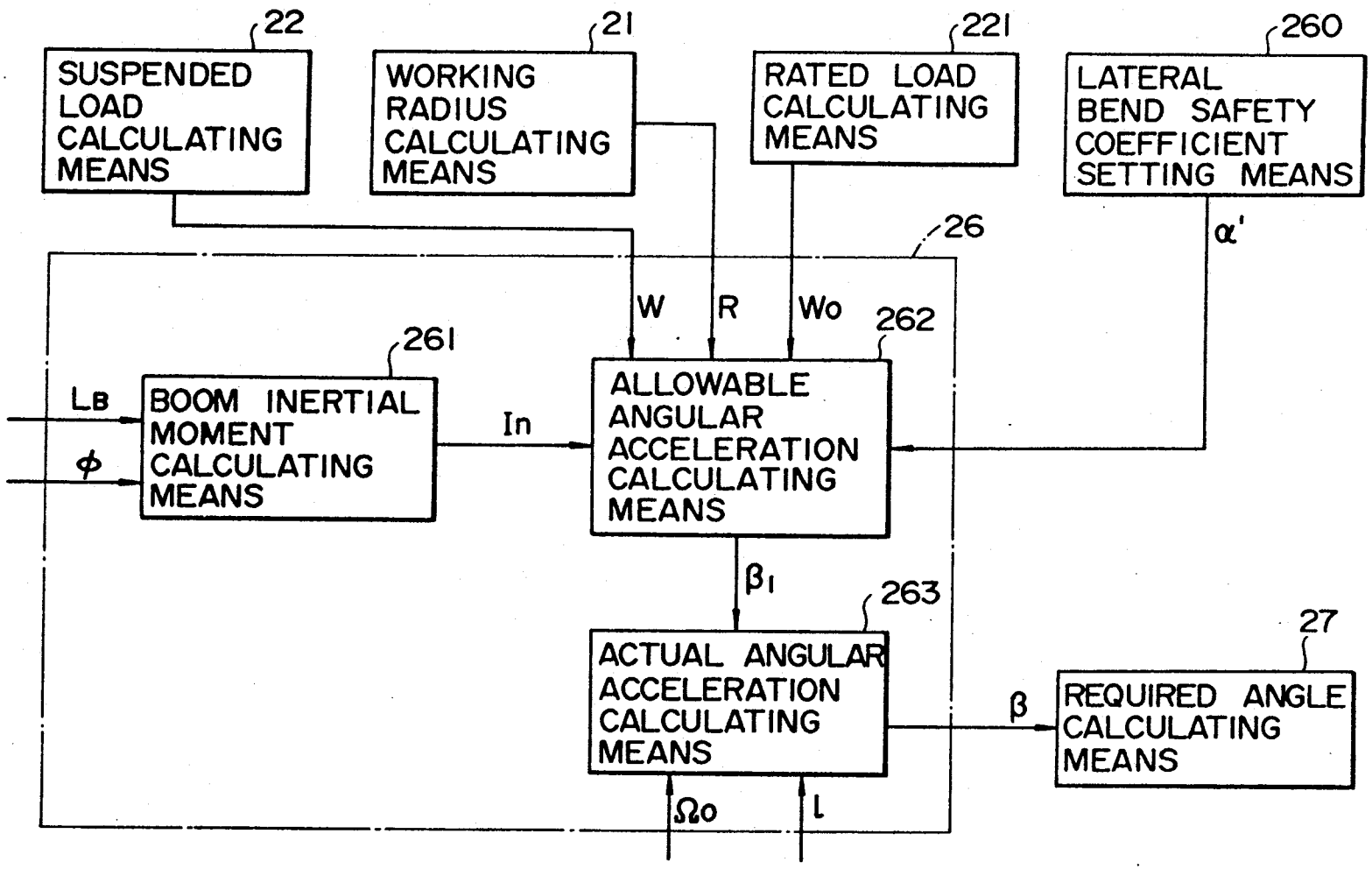
FIG. 3 is a functional block diagram of braking angular acceleration calculating means of the calculating controlling device shown in FIG. 2.

In the meantime, braking angular acceleration calculating means 26 calculates an actual braking angular acceleration $\beta$ using the working radius R, the suspended load W, the rated load $W_0$, the boom length $L_B$, the boom angle $\phi$, an angular velocity $\Omega_0$ and a radius l of shaking movement of the suspended cargo C detected by the angular velocity sensor 16 and the rope length sensor 17, respectively, and a lateral bend safety coefficient $\alpha'$ set by lateral bend safety coefficient setting means 260 shown in FIG. 3. In particular, referring to FIG. 3, the braking angular acceleration calculating means 26 includes boom inertial moment calculating means 261, allowable angular acceleration calculating means 262 and actual angular acceleration calculating means 263 and calculates a braking angular acceleration $\beta$ with which no shaking movement of the suspended cargo C will be left upon stopping and which takes lateral bend strength of the boom B against inertial force upon braking or stopping into consideration.

Required angle calculating means 27 calculates, using an angular velocity $\Omega_0$ before starting of braking against swinging, an angle (required angle) $|\theta t|$ over which the boom B is swung until the boom B is stopped after starting of braking at the braking angular acceleration $\beta$. Marginal angle calculating means 28 calculates a marginal angle $\Delta\theta$ which is a difference between the remaining angle $\theta_o$ and the required angle $|\theta t|$.

Second alarm controlling means 293 delivers a control signal to the alarm device 31 to provide an alarm at a point of time when the calculated marginal angle $\Delta\theta$ becomes smaller than a predetermined value. Second stopping controlling means 294 delivers, at a point of time when the marginal angle $\Delta\theta$ is reduced to 0, a control signal to a motor in the hydraulic system 33 to brake and stop swinging movement of the boom B at the braking angular acceleration $\beta$ and to compulsorily stop any movement which involves an increase of the working radius.

A limit working region is set by the means described so far, and a safety operation is controlled based on comparison of the limit working region and a current working condition.

Subsequently, contents of calculations and contents of control actually executed by the calculating controlling device 20 will be described.

1) Calculating Control relating to a Load Factor

The working radius calculating means 21 first calculates, using a boom length $L_B$ and a boom angle $\phi$, a working radius R' which does not take a lateral bend of the boom B into consideration and a radius increment $\Delta R$ arising from a lateral bend of the boom B, and then calculates a working radius R using the working radius R' and the radius increment $\Delta R$. The suspended load calculating means 22 calculates a load W of an actually suspended cargo C using the thus calculated working radius R, the boom length $L_B$ and a cylinder pressure p. The rated load calculating means 221 either recalls a rated load $W_0$ corresponding to a current swinging angle $\theta$ from within a memory in which set rated loads are stored or calculates such rated load $W_0$ from one of values of the memory by an interpolation calculation using the working radius R, the boom length $L_B$, projection amounts of the outrigger jacks 105 and a predetermined coefficient $\alpha$. Further, the load factor calculating means 23 calculates a load factor $W/W_0$ using the rated load $W_0$.

In case the load factor $W/W_0$ is higher than 90%, an alarm is developed from the alarm device 31 which receives an output signal of the first alarm controlling means 291, and consequently, the operator can become aware that the load W of the suspended cargo C is approaching the rated load $W_0$. On the other hand, when the load factor $W/W_0$ exceeds 100%, that is, when the actual load W is higher than the rated load $W_0$, any other crane operation (such as extension or tilting down movement of the boom B or winding up of the suspended cargo C) than a swinging operation is stopped compulsorily in response to an output signal of the first stopping controlling means 292 in order to prevent inadvertent possible danger.

2) Calculating Control Relating to a Limit Working Region

The limit working region setting means 24 sets a limit working region in response to the suspended load W, projection amounts $d_1$ to $d_4$ of the individual outrigger jacks 105 and the boom length $L_B$.

Figure 4:
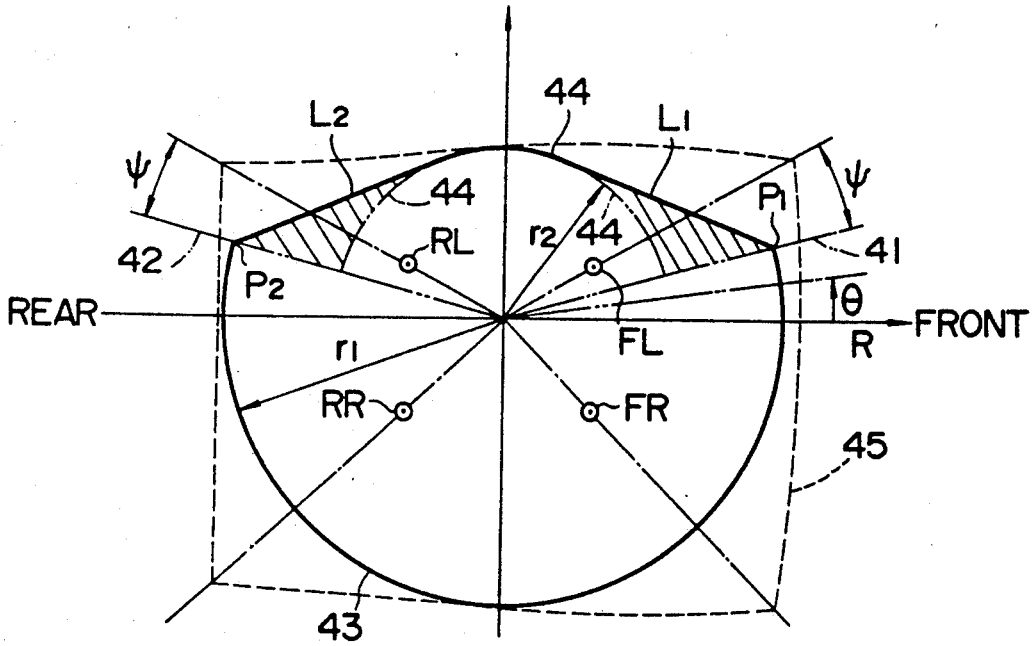
FIG. 4 is a diagram showing a limit working region on an R-$\theta$ plane set by the calculating controlling device of FIG. 1.

A manner of such setting is illustrated in FIG. 4. Referring to FIG. 4, straight lines are first drawn from the center O of swinging movement of the crane 10 to projected positions FL, FR, RL and RR of the individual outrigger jacks 105, and lines displaced by a predetermined fixed angle $\psi$ from those of the straight lines on the side on which projection amounts of the outrigger jacks 105 are smaller (on the left-hand side of the crane 10 in the case shown in FIG. 4) are determined as boundary lines 41 and 42. Then, a region on the right-hand side of the crane 10 with respect to the boundary provided by the boundary lines 41 and 42 is determined as a stable section, and in this section, a maximum allowable working radius (first allowable working radius) $r_1$ corresponding to the actual suspended load W is set. In particular, a limit working region in this section makes a sectoral shape surrounded by an arc 43 having a radius equal to $r_1$. Meanwhile, if the four outrigger jacks 105 are all projected to the utmost, then all the inside of a full circle having the radius $r_1$ makes a limit working region.

Figure 5:
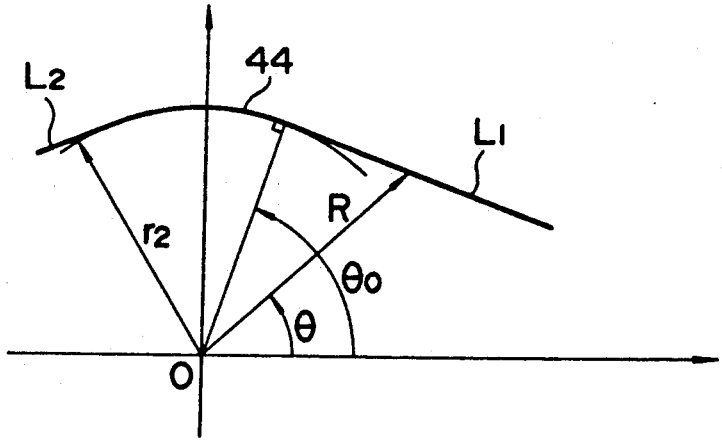
FIG. 5 is a diagram showing part of the limit working region shown in FIG. 4.

On the other hand, a region on the left-hand side of the crane 10 with respect to the boundary provided by the boundary lines 41 and 42 is determined as an unstable section. Conventionally, a limit working region defined by an arc 44 having a second allowable working radius $r_2$ smaller than the first allowable working radius $r_1$ is set (refer to an alternate long and two short dashes line of FIG. 4), but in the present arrangement, also as shown in FIG. 5, tangential lines $L_1$ and $L_2$ are drawn from boundary points $P_1$ and $P_2$ on the individual boundary lines 41 and 42 to the arc 44, and a region defined by the tangential lines $L_1$ and $L_2$ and part of the arc 44 is set as a limit working region.

Accordingly, a boundary line of the limit working region set by the limit working region setting means 24 is represented generally by a relational expression $\theta=f(R)$ of the swinging angle $\theta$ and the working radius R. Particularly, in the stable region, $R=r_1$ (constant), but in a most unstable section (portion of the arc 44) in the unstable region, $R=r_2 \leqq r_1$ (constant). Meanwhile, as to any other region, that is, as to portions of the tangential lines $L_1$ and $L_2$, where a swinging angle at a location where the circle 44 changes into the straight line $L_1$ as shown in FIG. 5 is represented by $\theta_0$, then an expression $$R \cos(\theta_0-\theta)=r_2$$

stands, and accordingly, the tangential line $L_1$ is represented by a relational expression $$\theta=\theta_0-\cos^{-1}(r^2/R)$$

Figure 6:
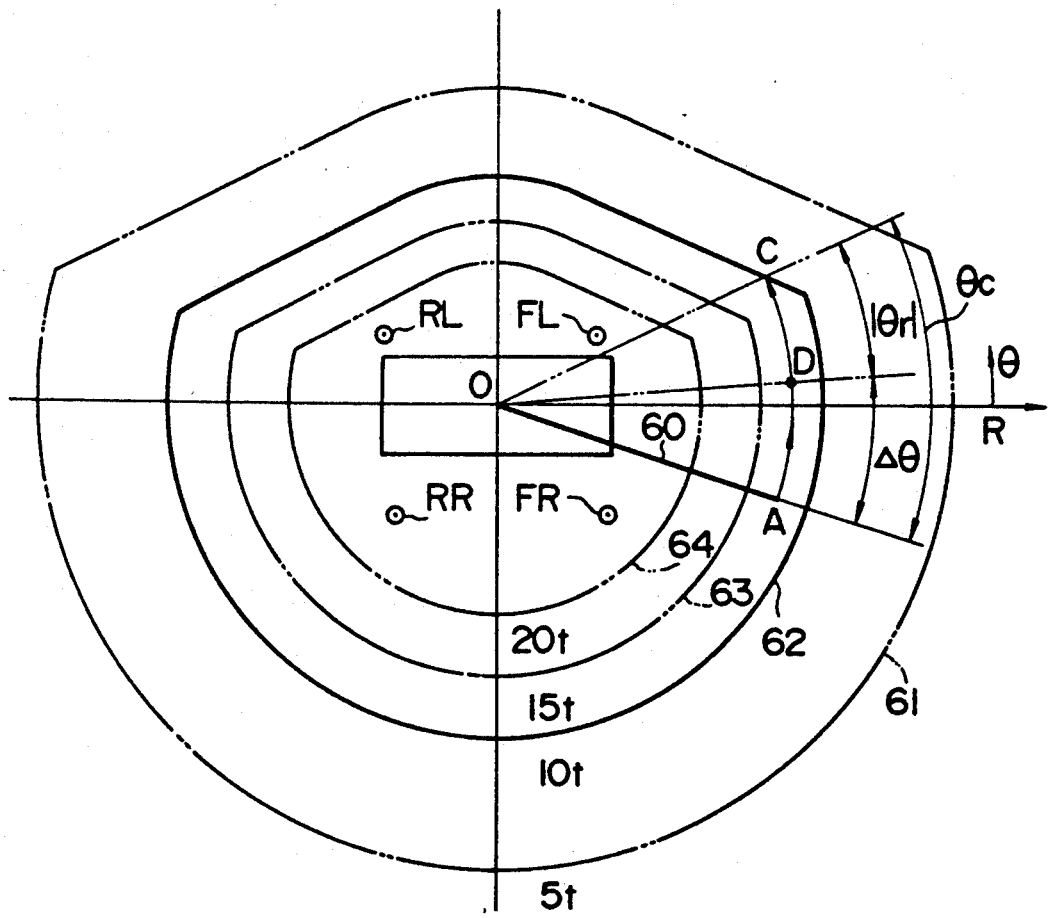
FIG. 6 is a diagrammatic representation showing an image on an R-$\theta$ plane indicated on a display unit.

It is to be noted that the allowable working radii $r_1$ and $r_2$ may be calculated successively in response to a suspended load W or otherwise values thereof may be stored in a memory for individual divided stages of the suspended load W. For example, where the projection amounts $d_1$ to $d_4$ of the individual outrigger jacks 105 are fixed, limit working regions corresponding to the individual suspended loads W all make substantially similar shapes as shown in FIG. 6 (refer to a solid line 62 and alternate long and short dashes lines 61, 63 and 64).

Referring back to FIG. 2, the remaining angle calculating means 25 calculates, using the current working radius R and swinging angle $\theta$, a remaining angle $\theta_0$ until the limit working region is exceeded by swinging movement. For example, in case the crane 10 supports a suspended load of 10 tons thereon, the limit working region is the inside of the thick solid line 62 shown in FIG. 6. On the other hand, in case the position of the current boom point is represented by A and swinging movement is performed with the same working radius in the direction of A→B→C, where the intersecting point of an arc with center at the center O of the swinging movement and the regional line of the limit working region is represented by C, then the angle defined by straight lines OA and OC is a remaining angle $\theta_o$.

In the meantime, the braking angular acceleration calculating means 26 follows the following procedure to calculate a braking angular acceleration $\beta$ which takes lateral bend strength of the boom B into consideration and with which a shake of the cargo will not be left.

Referring to FIG. 3, the boom inertial moment calculating means 261 first calculates inertial moments $I_n$ of the individual boom members $B_n$ in accordance with the following expression.

$$I_n = I_{n0} \cdot \cos^2\phi + (W_n/g) \cdot R_n^2$$

where $I_{n0}$ is an inertial moment (constant) around the center of gravity of each boom member $B_n$, $W_n$ is a self weight of each boom member $B_n$, g is the acceleration of free fall, and $R_n$ is a swinging radius of the center of gravity of each boom member $B_n$.

The allowable angular acceleration calculating means 262 calculates an allowable angular acceleration $\beta_1$ in the following manner.

Generally, the boom B and the boom foot 102 of the crane 10 have sufficient strengths. However, if the boom length $L_B$ increases, then great bending force arising from inertial force which is generated upon braking against swinging movement acts upon the boom B. Since the burden in strength by such lateral bending force is maximum around the boom foot 102, strength evaluation will be performed here based on a moment around the swinging axis 101.

Particularly, if the angular acceleration of the boom B upon braking against swinging movement is represented by $\beta'$ and the angular acceleration of the suspended cargo C is represented by $\beta''$, then a moment $N_B$ which arises from swinging movement of the boom B and acts upon the center of such swinging movement is represented by the following expression:

$$N_B = (W/g)\, R^2\, \beta'' + \sum_{n=1}^{N} I_n\, \beta' \qquad (1)$$

where W is a suspended load calculated by the suspended load calculating means 22. Meanwhile, if the rated suspended load of the boom B is represented by $W_0$ and the evaluation coefficient to a lateral bend is represented by $\alpha$, then an allowable condition of the strength against a lateral bend of the boom B is represented by the following expression (2):

$$N_B/R \leqq \alpha' W_0 \qquad (2)$$

By substituting the expression (2) into the expression (1), we obtain $$(W/g)\, R\, \beta'' + \sum_{n=1}^{N} I_n\, \beta'/R \leqq \alpha'\, W_0 \qquad (3)$$

Figure 11:
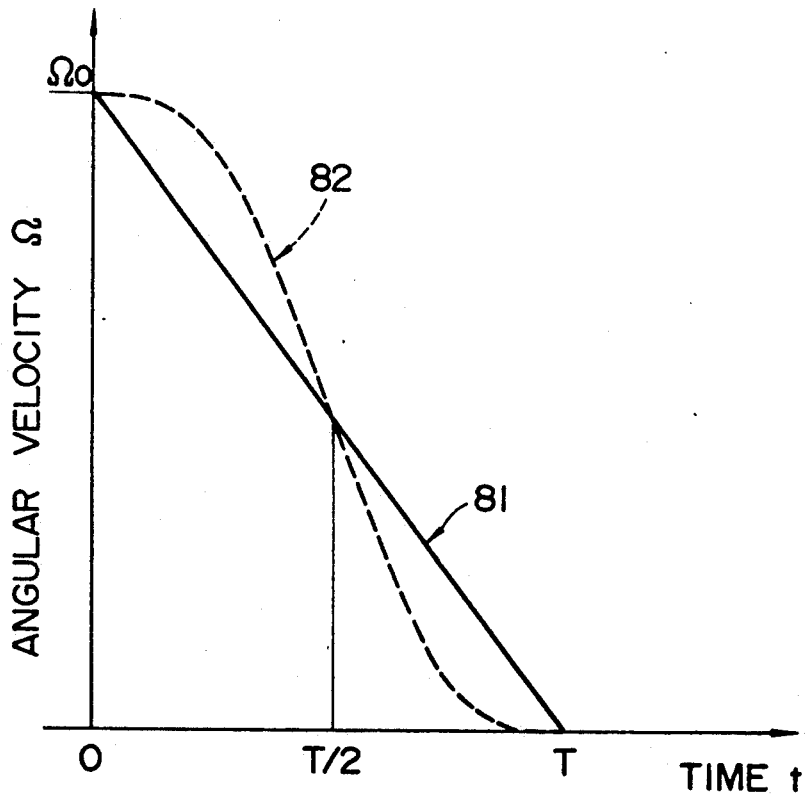
FIG. 11 is a graph showing characteristics of variations of an angular velocity of a suspended cargo and an angular velocity of a boom.

Meanwhile, it is confirmed that, in case the boom B is braked at an equal angular velocity in the following conditions from a condition in which the suspended cargo C is free from a shake and the boom B and the suspended cargo C are both making swinging movement at an angular velocity $\Omega_0$, the angular acceleration $\beta'$ of the boom B and the angular acceleration $\beta''$ of the suspended cargo C have such a relationship as shown in FIG. 11.

Referring to FIG. 11, relationships of an angular velocity $\Omega$ of the boom B and an angular velocity $\Omega_0$ of the suspended cargo C to time when the natural number n which is introduced into an expression (8) which will be hereinafter described are shown by a solid line 81 and a broken line 82, respectively. As seen in FIG. 11, in case such equal angular acceleration stopping control wherein the boom B is stopped at a time t=T after starting of braking is executed, the angular velocity $\Omega$ of the boom B decreases linearly while the angular velocity $\Omega_W$ of the suspended cargo C decreases moderately directly after starting of braking and directly before stopping but decreases suddenly in an intermediate region. In particular, the angular velocity $\Omega_W$ of the suspended cargo C makes an oscillation of one cycle by full stopping and becomes equal to the angular velocity $\Omega$ of the boom B at a point of time when the time t=T/2 after starting of braking. Besides, the angular acceleration $\beta''$ of the suspended cargo C at the point of time is twice the angular acceleration $\beta'$ of the boom B.

On the other hand, in case the natural number n is greater than 2, the gradient of the angular velocity $\Omega$ of the boom B is 1/n and accordingly the angular velocity $\Omega_W$ of the suspended cargo C makes oscillations for n cycles from starting to stopping of braking, but similarly as in the case of n=1, the angular acceleration $\beta''$ of the suspended cargo C is twice the angular acceleration $\beta'$ of the boom B when it is in the minimum (maximum in absolute value).

Accordingly, the safety of the crane can be theoretically assured by proceeding with calculations using $\beta''=2\beta'$. Actually, however, the suspended cargo C is sometimes shaking upon starting of braking against swinging movement, and if such shake is present, the angular acceleration $\beta''$ of the suspended cargo C during braking may exceed the twice the angular acceleration $\beta'$ of the boom B.

Therefore, in executing actual control, it is desirable to introduce, taking a safety factor into consideration, a coefficient k having a value k>2 and proceed the calculations using $\beta''=k\beta'$.

Thus, if the expression $\beta''=k\beta'$ is substituted into the expression (3) above, then $$(W/g)\,R\cdot k\beta' + \sum_{n=1}^{N} I_n\,\beta'/R \leqq \alpha'\,W_0 \tag{4}$$

is obtained. Accordingly, the maximum angular acceleration $\beta'$ which satisfies the expression (4) should be set as the allowable angular acceleration $\beta_1$. It is to be noted that, while the evaluation coefficient $\alpha'$ may be set to a fixed value, it may be set otherwise such that it may decrease as the working radius R of the boom $L_B$ increases.

Referring back to FIG. 3, the actual angular acceleration calculating means 263 calculates an actual braking angular acceleration $\beta$ using the allowable angular acceleration $\beta_1$ calculated in this manner and a boom angular velocity (angular velocity before deceleration) $\Omega_0$ and a cargo shaking radius l which are both calculated using results of detection of the angular velocity sensor 16 and the rope length sensor 17, respectively.

Figure 7:
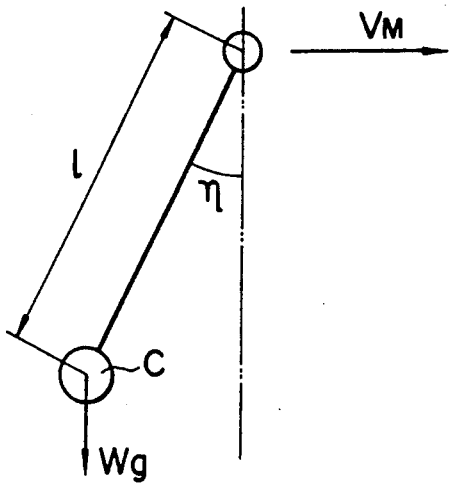
FIG. 7 is a diagram showing a suspended cargo operating a single pendulum.
Figure 8:
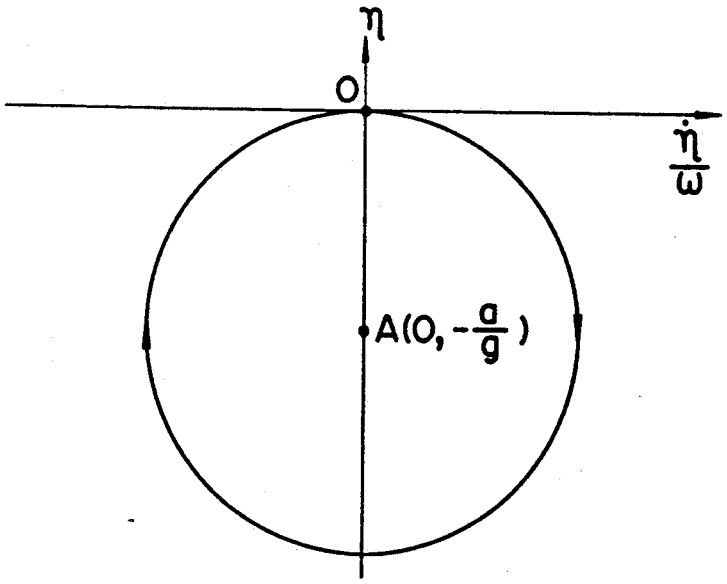
FIG. 8 is a graph illustrating an expression regarding a shaking angle and a shaking velocity of a suspended cargo on a phase space.

A manner of such calculations will be described subsequently. First, such a model of a single pendulum as shown in FIG. 7 is considered with regard to the suspended cargo C suspended on the crane 10. A differential equation of the present system is given by the following expression.

$$\ddot{\eta}+(g/1)\eta=-V/l \tag{5}$$

$$V=V_0+a\,t \tag{6}$$

where $\rho$ is a shaking angle of the suspended cargo C, V is a swinging velocity of the boom point which varies with respect to time t, $V_0$ is a swinging speed ($=R\Omega_0$) of the boom point before starting of a stopping operation of swinging movement, and a is an acceleration of the boom point. If the opposite sides of the expression (6) are differentiated by the time t and substituted into the right-hand side of the expression (5) and then the expression (5) is integrated under initial conditions ($\rho=0$ and $\rho=0$ at $t=0$), then the following expression (7) is obtained.

$$(\eta/\omega)^2+(\eta+a/g)^2=(a/g)^2 \tag{7}$$

where $\omega=\sqrt{g/l}$.

If the expression is indicated on a phase plane of $\rho/\omega$ and $\rho$, then a circle is drawn which has the center at the point A (0, $-a/g$) and passes the origin O (0, 0). Since the time required for going round the circle, that is, a period T for which the condition of the single pendulum varies from the origin 0 until the same condition is restored, is given by $T=2\pi/\omega$, if the angular acceleration $\beta$ is set such that the crane 10 may be stopped completely after lapse of an interval of time equal to nT (n is a natural number) after the point of time (point A) of starting of swinging stopping control of the crane, then the crane can be stopped without leaving any shaking of the suspended cargo C. Meanwhile, since $\omega$ appearing as above is a fixed value which is determined from the acceleration g of free fall and the shaking radius l, the angular acceleration $\beta$ at which swinging stopping control with which shaking of the cargo is not left is possible can be calculated in accordance with the following expression.

$$\begin{aligned}\beta &= \Omega_0/n\,T\\ &= -\omega\,\Omega_0/2\,n\,\pi\end{aligned} \tag{8}$$

where n is a natural number.

Meanwhile, as for the lateral bend strength of the boom B, since $|\beta|\leqq\beta_1$ is a requirement, if a minimum natural number n within a region within which the requirement is satisfied is selected, then an actual braking angular acceleration $\beta$ for braking and stopping the crane without leaving a shake of the cargo in a minimum necessary period of time can be obtained.

The required angle calculating means 27 calculates, using a current angular velocity (that is, an angular velocity before braking) $\Omega_0$, a swinging angle (required angle) $|\theta_r|$ required from starting of braking to complete stopping when swinging stopping control is to be performed at the braking angular acceleration $\beta$. Particularly, where the required time from starting of braking to completion of stopping is represented by t, then the following two expressions $$\Omega_0+\beta t=0$$

$$\theta_r=\beta t^2/2+\Omega_0 t$$

stand. Thus, if t is eliminated from the two expressions, then a required angle $|\theta_r|$ is obtained. Particularly, the following value is obtained:

$$t=-\Omega_0/\beta$$

$$\theta_r=-\Omega_0^2/2\beta$$

Referring back to FIG. 2, the marginal angle calculating means 28 calculates an angle over which the boom B can be swung at the current angular velocity $\Omega_0$ before braking is started, that is, a marginal angle $\Delta\theta$ ($=\theta_o-|\theta_r|$). For example, as the position at which braking must be started in order to achieve complete stopping at the position C in FIG. 6, the marginal angle $\Delta\theta$ is an angle defined by the straight lines OA and OD.

The second stopping controlling means 294 delivers a control signal to the hydraulic system 33 at a point of time when the calculated marginal angle $\Delta\theta$ is reduced to 0, for example, at a point of time when the boom B comes to the position D in FIG. 6 to perform braking against swinging movement of the boom B and compulsory stopping of an operation in which the working radius is increased. In this instance, in order to eliminate a possible shake of the suspended cargo C upon stopping, the hydraulic motor pressure $P_B$ is set so that braking and stopping may be performed at the braking angular acceleration $\beta$.

An example of a manner of calculation of such hydraulic motor pressure $P_B$ will be described. Now, if the sum total of inertial moments with respect to swinging members other than the boom B is represented by $I_u$, then torque $T_B$ required for braking against swinging movement is given by $$T_8 = |(W/g)\,R^2\cdot k\beta + \sum_{n=1}^{N} I_n\,\beta + I_n\,\beta| \tag{9}$$

Figure 12:
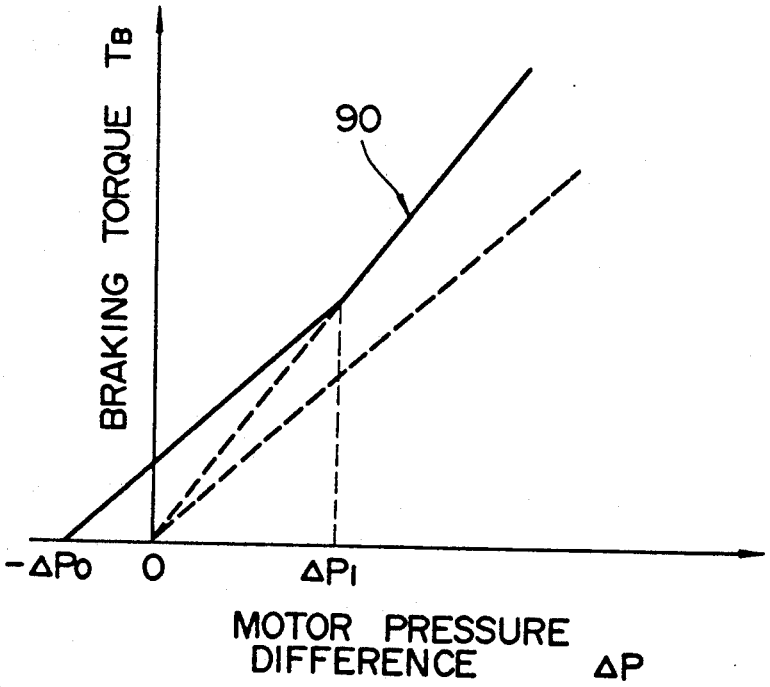
FIG. 12 is a graph showing a relationship between a pressure difference in a hydraulic motor and braking torque.

In the meantime, the torque $T_B$ has such a relationship to a condition of the hydraulic motor side (a pressure difference $\Delta P$ of the hydraulic motor) as indicated by a solid line in FIG. 12 and is represented in the following expression:

i) in the case of $-\Delta P_0 \leqq \Delta P < \Delta P_1$ $$T_B = (\Delta P + \Delta P_0) \cdot Q_H / 200\pi \quad (10)$$

ii) but in the case of $\Delta P \geqq \Delta P_1$ $$T_B = (\Delta P \cdot Q_H / 200\pi) \cdot i_0 \cdot \eta_m \quad (11)$$

where $Q_H$ is a motor capacity, $i_0$ is a total speed reducing ratio, $\eta_m$ is a mechanical efficiency, and $\Delta P_0$ is a pressure loss of the motor in a no load condition.

It is to be noted that the motor pressure difference $\Delta P_1$ represents a value of the pressure difference $\Delta P$ at an intersecting point between a straight line represented by the expression (10) given above and another straight line represented by the expression (11) given above.

Accordingly, by substituting the expression (10) or (11) given above into the expression (9) above, a pressure difference $\Delta P$ of the hydraulic motor can be obtained.

Further, if the driving side pressure of the hydraulic motor is represented by $P_A$, a braking side pressure $P_B$ of the hydraulic motor can be obtained in accordance with the following expression (12):

$$P_B = P_A + \Delta P \quad (12)$$

On the other hand, the second alarm controlling means 293 delivers a control signal to the alarm device 31 at a point of time at which the marginal angle $\Delta\theta$ is reduced not to 0 but to a value smaller than a predetermined value so as to provide an alarm. By such alarm, the operator can know that braking will be rendered effective automatically after further small swinging movement.

Further, referring to FIG. 1, the calculating controlling device 20 delivers information signals regarding the individual values to the display unit 32 so as to provide such a screen indication as shown in FIG. 6. In particular, referring to FIG. 6, the display unit 32 indicates, on the screen thereof, a position of the lower frame of the crane 10, projected positions FL, FR, RL and RR of the individual outrigger jacks 105, a limit working region (the solid line 62 in case the suspended load W is, for example, 10 tons), and a line segment 60 which represents both of a working radius R and a swinging angle $\theta$. Consequently, the operator can recognize a relationship between current working conditions and a limit working region at a glance.

3) Particular Example of Controlling Operation Actually Executed

Figure 10:
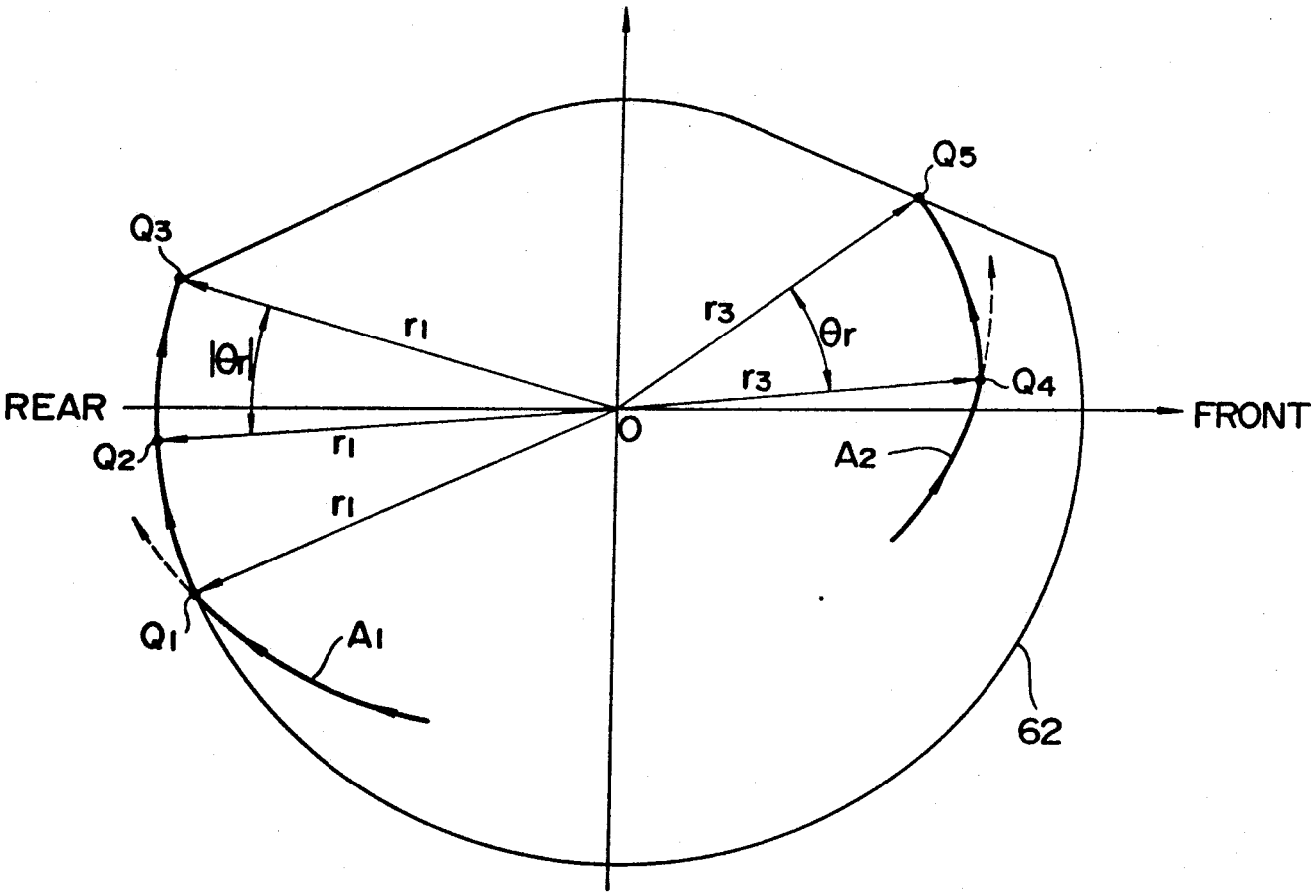
FIG. 10 is a diagram illustrating controlling operation to be actually executed with the crane.

Here, an example of controlling operation when a suspended cargo C of 10 tons is suspended on the crane 10 and swinging movement is performed while the working radius R is being expanded (that is, while the boom B is being extended or tilted down) will be described with reference to FIG. 10.

First, description will be given of a case wherein the suspended cargo C comes to the boundary line (solid line 62) of the limit working region in the stable section, that is, a case wherein the working radius R is expanded to $r_1$ and the load factor is increased to 100% (refer to an arrow mark $A_1$) before the remaining angle is reduced to the required angle $|\theta_r|$ for braking.

In this instance, at a point at which the working radius R is reduced to $r_1$ (at a point $Q_1$), extension and tilting down of the boom B and winding up of the suspended cargo C are compulsorily stopped in response to an output signal of the first stopping controlling means 292, but since the remaining angle $\theta_o$ remains in a condition in which it is greater than the required angle $|\theta_r|$, the swinging movement is continued in a condition in which the swinging radius R is fixed to $r_1$. In other words, swinging movement is performed along the boundary line of the limit working region. Then, at another point at which the remaining angle $\theta_o$ is reduced to the required angle $|\theta_r|$ (at a point $Q_2$), braking to swinging movement is started in response to an output signal of the second stopping controlling means 294, and the swinging movement is stopped completely at a further point $Q_3$ which is a regional point between the stable section and the unstable section.

Accordingly, in this instance, the working radius R is first fixed by the first stopping controlling means 292, and then braking and stopping of swinging movement is performed by the second stopping controlling means 294.

Subsequently, description will be given of a case wherein braking to swinging movement is started before the suspended cargo C reaches the boundary line of the limit working region, that is, a case wherein the remaining angle $\theta_o$ is reduced to the required angle $|\theta_r|$ (refer to an arrow mark $A_2$) before the load factor is increased to 100% by expansion of the working radius R.

In this instance, at a point at which the remaining angle $\theta_o$ is reduced to the required angle $|\theta_r|$ (at a point $Q_4$), braking to swinging movement is started and also expansion and tilting down of the boom B, that is, an operation by which the working radius R is to be increased, is also stopped compulsorily in response to an output signal of the second stopping controlling means 294, and the working radius R is fixed to a radius $r_3$ at the point of time.

Here, the reason why the working radius R is fixed is that, if braking is performed otherwise while the working radius is being expanded, then the final stopping point will exceed the limit working region. In other words, if braking is started while the working radius R is held fixed to $r_3$ in this manner, swinging movement is stopped completely at a point $Q_5$ on the boundary line of the limit working region.

Accordingly, in this instance, both of fixation of the working radius R and braking and stopping of swinging movement are executed by the second stopping controlling means 294.

It is to be noted that, in such an operation as will decrease the working radius R, that is, in contraction and tilting down of the boom B, the safety is not likely reduced even if such an operation is performed, and accordingly, such compulsory stopping as described above is not performed in principle.

As described so far, in the present device, since a required angle $|\theta_r|$ for braking and stopping swinging movement without leaving a shake of a suspended cargo C and a remaining angle $\theta_o$ over which the boom B can be swung until a limit working region is exceeded are calculated and a safety operation such as swinging stopping control or alarming is performed based on comparison between the two angles, the crane can be stopped with safety and with certainty within the limit working region. Particularly, an alarm is provided at a point of time before the two angles become coincident with each other in order to draw an attention of an operator to control of the swinging velocity, and at the point at which the two angles coincide with each other, braking to swinging movement is started automatically at a braking angular acceleration with which no shake of the cargo will be left.

Further, since the line segment 60 indicating a working radius R and a swinging angle $\theta$ and a limit working region are indicated on the same screen of the display unit 32, the operator of the crane can recognize a relationship between swinging conditions including a swinging angular velocity and the limit working region accurately at a glance, and consequently, precise swinging operation which takes the safety into consideration can be performed.

It is to be noted that the present invention is not limited to the embodiment described above but can have the following forms as examples.

(1) While in the embodiment described above a device is described which executes both of control of a safety operation and indication of a screen, the safety of the crane can be assured satisfactorily even with a device which executes only one of them. As regards the safety operation described above, both of braking and stopping of swinging movement and alarming need not be performed, but only one of them may be performed.

(2) While in the embodiment described above braking is started at a point of time when the marginal angle $\Delta\theta$ is reduced to 0, braking may be started when the angle $\Delta\theta$ is reduced to a value lower than a predetermined value involving a margin in time.

(3) While in the embodiment described above alarming is started when the marginal angle $\Delta\theta$ is reduced to a value lower than a predetermined value, it may be started otherwise at a point of time when a marginal time $\Delta t$ obtained by dividing the marginal angle $\Delta\theta$ by an angular velocity $\Omega_0$ is reduced to a value lower than a fixed value (such as, for example, 3 seconds). If such control is executed, then a margin is provided always for a fixed period of time irrespective of the angular velocity $\Omega_0$ before braking is started after starting of alarming. Further, also the timing of starting of swinging stopping control may be set similarly in accordance with the marginal time $\Delta t$.

(4) While the display unit 32 indicates a limit working region and a line segment 60 thereon, it is more effective if it additionally indicates a point (the point D in FIG. 6) at which braking to swinging movement is started.

(5) In the present invention, a detailed profile of a limit working region is not the matter, and, for example, control may be executed in accordance with a region which is defined by an arc 43 having such a first allowable working radius $r_1$ as in a conventional technique and another arc 44 having an allowable working radius of FIG. 1. However, if a region is set which varies continuously from the first allowable working radius $r_1$ to the second allowable working radius $r_2$ as in the embodiment described hereinabove, then a wider region in which working can be made can be assured. Particularly where a limit working region is indicated on the display unit 32, since the profile of the region is natural, the operator does not have an unfamiliar feeling and can recognize the region readily.

(6) Detection of a swinging angular velocity in the present invention may be achieved either by means of a sensor provided for the exclusive use or from a time differentiated value of a swinging angle sensor.

(7) While in the embodiment described above "an extensible support member" in the present embodiment is described including outrigger jacks, the present invention can be applied to a crawler crane which includes crawlers which can be extended in widthwise directions of a body. In particular, also in such a crawler crane, in case it is to be used in a condition wherein extension widths of the crawlers in the leftward and rightward directions are different from each other, since the suspending capacity varies depending upon the swinging direction, similar superior effects to those described above can be obtained by application of the present invention.

Having now fully described the invention, it will be apparent to one of ordinary skill in the art that many changes and modifications can be made thereto without departing from the spirit and scope of the invention as set forth herein.

What is claimed is:

1. A safety device for a crane which includes a boom mounted for swinging movement and a plurality of ground engaging support members mounted for projecting movement and wherein a suspended cargo is suspended at a predetermined position of said boom, said safety device comprising:

working radius detecting means for detecting a working radius of said boom, swinging angle detecting means for detecting a swinging angle of said boom, support member detecting means for detecting projection amounts of said support members, limit working region setting means sensitive to said support member detecting means for setting a limit working region of said boom in accordance with a weight of the suspended cargo and projection amounts of each of said support members, remaining angle calculating means for calculating a remaining angle over which said boom can be swung until the set limit working region is exceeded, braking angular acceleration calculating means for calculating a braking angular acceleration at which swinging movement of said boom is braked and stopped without leaving a shake of the suspended cargo, required angle calculating means for calculating a required swinging angle of said boom required to brake and stop the swinging movement of said boom at the braking angular acceleration, comparing means for comparing the thus calculated required angle and the remaining angle, and operating means for performing a safety operation before the remaining angle exceeds the required angle.

2. A safety device for a crane which includes a boom mounted for swinging movement and a plurality of ground engaging support members mounted for projecting movement and wherein a suspended cargo is suspended at a predetermined position of said boom, said safety device comprising;

working radius detecting means for detecting a working radius of said boom, swinging angle detecting means for detecting a swinging angle of said boom, support member detecting means for detecting projection amounts of said support members, limit working region setting means sensitive to said support member detecting means for setting a limit working region of said boom in accordance with a weight of the suspended cargo and projection amounts of each of said support members, and display means for indicating the thus set limit working region and a current working radius and swinging angle of said boom on the same screen.

3. The safety device of claim 1 wherein said required angle calculating means comprises means for calculating the required angle $\theta_r$ according to:

$$\theta_r = -\Omega_0^2/2\beta,$$

where $\Omega_0$ is an angular velocity of said boom at a time immediately before the boom is braked, and $\beta$ is the braking angular acceleration.

4. The safety device of claim 3 wherein said operating means includes means for setting a pressure difference $\Delta P$ between a driving side pressure and a braking side pressure of a boom braking hydraulic motor such that braking angular acceleration is $\beta$.

* * * * *